US005769094A

United States Patent [19]

Jenkins, Jr. et al.

[11] Patent Number: 5,769,094

[45] Date of Patent: Jun. 23, 1998

[54] FOLDING KNIFE WITH BLADE CARRIER

[76] Inventors: R. B. Jenkins, Jr., P.O. Box 2089, Gastonia, N.C. 28053-2089; Walter W. Collins, P.O. Box 100, North, S.C. 29112

[21] Appl. No.: 777,358

[22] Filed: Dec. 27, 1996

[51] Int. Cl.[6] ..... B26B 1/02

[52] U.S. Cl. ..... 30/161; 30/160; 30/331

[58] Field of Search ..... 30/155, 156, 157, 30/160, 161, 330, 331

[56] References Cited

U.S. PATENT DOCUMENTS

| | | | |
|---|---|---|---|
| 292,473 | 1/1884 | Dieterich et al. . | |
| 1,444,324 | 2/1923 | Brooks . | |
| 2,914,850 | 12/1959 | Kuhnl . | |
| 3,699,654 | 10/1972 | Gerling . | |
| 4,124,939 | 11/1978 | Onoue | 30/161 |
| 4,161,818 | 7/1979 | Phelps . | |
| 4,669,188 | 6/1987 | Evrell | 30/161 |
| 5,095,624 | 3/1992 | Ennis . | |
| 5,400,509 | 3/1995 | Collins . | |
| 5,461,786 | 10/1995 | Miller . | |
| 5,537,750 | 7/1996 | Seber et al. | 30/161 |
| 5,546,662 | 8/1996 | Seber et al. | 30/161 |

*Primary Examiner*—Hwei-Siu Payer

*Attorney, Agent, or Firm*—Leatherwood Walker Todd & Mann, P.C.

[57] ABSTRACT

A folding knife having a cantilevered leaf spring member with an engagement tab at the free end thereof. The engagement tab engages with a notch defined in a pivoting blade carrier pivotally connected to the knife handle member. Carried within the blade carrier is an interchangeable blade insert. When the blade is moved to an extended position, it is automatically locked in that position through engagement of the engagement tab with the notch in the blade carrier. Retraction of the blade requires pulling upwardly on ears provided adjacent the engagement tab to remove the engagement tab from the notch, such that the blade can be pivoted into a blade compartment provided in the handle member.

11 Claims, 4 Drawing Sheets

FOLDING KNIFE WITH BLADE CARRIER

BACKGROUND OF THE INVENTION

This invention relates generally to a folding knife having a blade carrier in which a blade insert is carried.

Various designs of folding knives are known having blades which lock in the open position. Typically, such folding knives include a back spring which engages the tang of the blade when the blade is in the closed position to prevent the blade from falling or "flopping" out from the knife handle when the blade is in a closed position. The back spring also bears against the curved end of the tang as the blade is moved from the closed position to the open position, thereby offering frictional resistance which must be overcome by the user when opening the blade. This resistance allows for positive control of the blade when it is moved to the open position, in that if the user releases the blade at some intermediate portion between the open and closed position, the blade remains in place, i.e., it does not snap back to the closed position, or to the open position, or swing freely therebetween.

While folding knives are available which allow the blade to be automatically locked once the blade is moved to the open or extended position, such knives typically require depression of an opposite end of a lock bar in order to release the blade to allow the blade to be moved to the closed position. As the area of the lock bar which must be depressed to release the blade could coincide with the portion of the handle gripped by the user during use of the knife, inadvertent pushing of the lock bar in that area could result in an unexpected closing of the knife during use, and which could result in injury to the user or damage to the object being cut or nearby objects.

Existing folding knives having a blade which automatically locks when moved to the extended position may also require a number of parts, and additionally, several moving parts, which could increase the cost and complexity of manufacture and assembly, and also provide more opportunities for failures and defects in the resulting knife. Simplicity in manufacture of knives is generally desirable in that such typically reduces costs of production and also improves reliability of the end product.

Folding knives having lockable blades have been patented. For example, U.S. Pat. No. 292,473, issued to Dieterich, et al., discloses a cigar dealer's knife having a folding blade and a lock-catch pivotally connected to the knife's handle. A tooth is provided on the lock-catch for engaging with a notch provided in the blade, such that the blade can be locked in the open position. Unlocking of the blade is apparently accomplished by pushing down on the opposite end of the lockcatch, such that the tooth becomes disengaged with the notch in the blade. U.S. Pat. Nos. 5,461,786, issued to Miller; 5,400,509, issued to Collins; and 4,161,818, issued to Phelps also disclose folding knives having blade locking bars, which are depressed in order to unlock the blade from the extended position. U.S. Pat. No. 5,095,624, issued to Ennis, discloses a lock system for a folding knife, wherein a toggle member which is lifted in order to allow closing of the blade.

A desirable feature for a folding knife can be the ability to accept a number of different blade styles, for example, a drop point, clipped point, or stiletto, etc., type blade. Having the ability to accept differing blade styles increases the versatility of the knife. It also provides for the use of disposable blades, in the event the user would rather buy or prefer to buy less expensive, sharp blades rather than resharpen a blade once it becomes dull.

U.S. Pat. No. 4,161,818, issued to Phelps, discussed above, discloses a folding pocket knife having replaceable blades. U.S. Pat. No. 2,914,850, issued to Kuhnl, discloses a razor blade knife having a folding carrier for receipt of a razor blade. U.S. Pat. No. 1,444,324, issued to Brooks, discloses a cutting implement having a folding clamping element for receipt of a blade.

While the foregoing designs are known, there still exists a need for a reliable and relatively easy to manufacture self-locking folding knife.

SUMMARY OF THE INVENTION

It is, therefore, the principal object of this invention to provide a folding knife having an improved blade lock release mechanism.

Another object of the present invention is to provide a folding knife capable of receiving interchangeable blades.

Yet another object of the present invention is to provide a folding knife having a blade locking mechanism which must be deliberately pulled upwardly in order to release the blade.

Still another object of the present invention is to provide a folding knife having molded moving parts.

Generally, the present invention includes a folding knife having a handle member, with a first end and a second end opposite the first end, which defines a blade compartment. A blade insert is provided having a cutting edge, and a blade carrier receives the blade insert. The blade carrier is pivotally connected to the first end of the handle member and is movable between a retracted position, substantially within the blade compartment, and an extended position, extending outwardly from the handle member.

The blade carrier defines a notch, and a leaf spring is provided having a first end with an engagement tab and a second end opposite the first end fixedly connected to the handle member. The engagement tab automatically engages the notch in the blade carrier upon the blade carrier being moved to the extended position, for locking the blade carrier in the extended position.

Specifically, in one embodiment of the present invention the handle member, blade carrier and leaf spring are molded plastic parts. In a further embodiment, the leaf spring includes outwardly extending ears provided adjacent the engagement tab, with the outwardly extending ears extending beyond the sides of the handle member to be grasped and pulled upwardly by the user to unlock the blade carrier (by disengaging the engagement tab from the notch in the blade carrier) , when it is desired to move the blade from the extended to the retracted position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
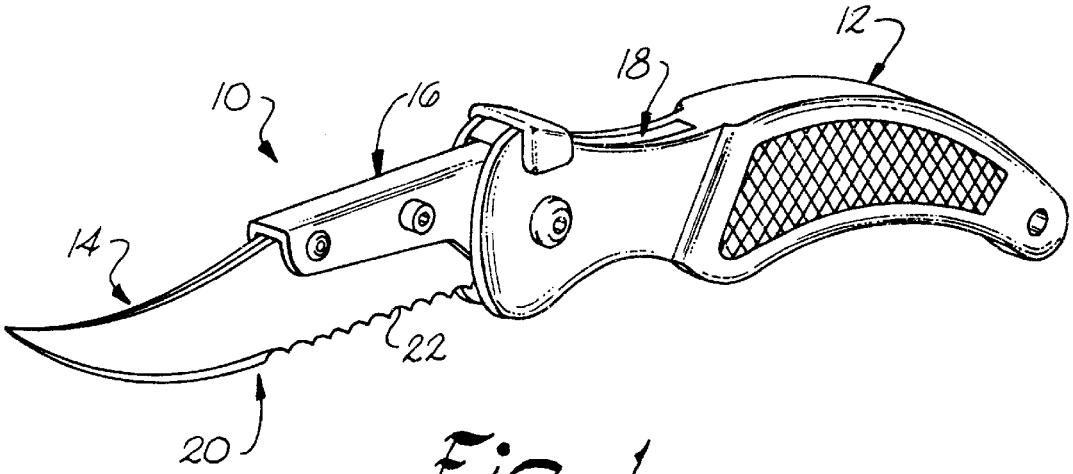
FIG. 1 is a perspective view of a folding knife with a blade carrier constructed in accordance with the present invention.

The accompanying drawings and the description which follows set forth this invention in its preferred embodiment. However, it is contemplated that persons generally familiar with folding knives will be able to apply the novel characteristics of the structures illustrated and described herein in other contexts by modification of certain details.

Accordingly, the drawings and description are not to be taken as restrictive on the scope of this invention, but are to be understood as broad and general teachings.

Referring now to the drawings in detail, wherein like reference characters represent like elements or features throughout the various views, the folding knife of the present invention is indicated generally in the FIGS. by reference character 10.

Figure 2:
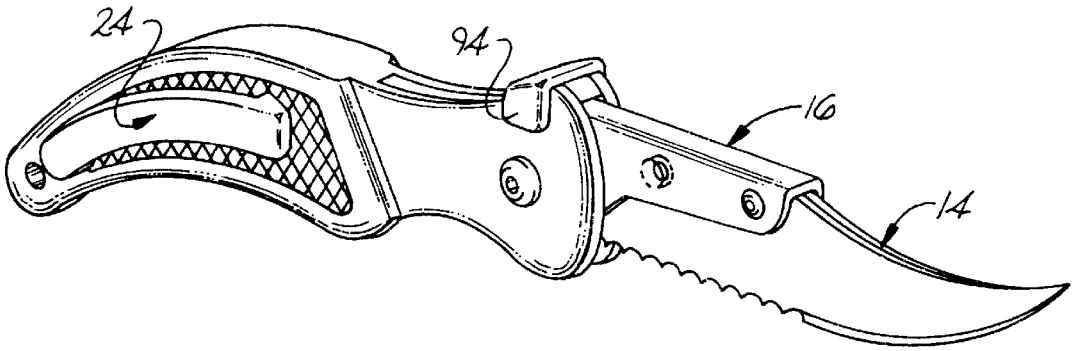
FIG. 2 is a perspective view showing the opposite side of the knife illustrated in FIG. 1.
Figure 4A:
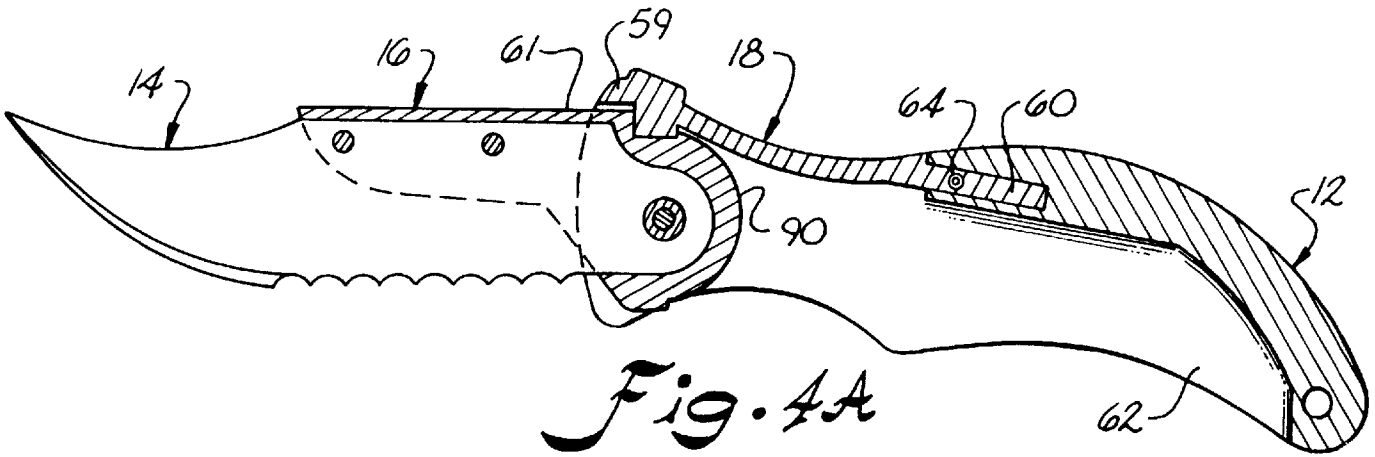
FIG. 4A is a sectional view of a knife constructed in accordance with the present invention, showing the blade carrier in an extended position and the engagement tab received in the blade carrier notch.
Figure 4B:
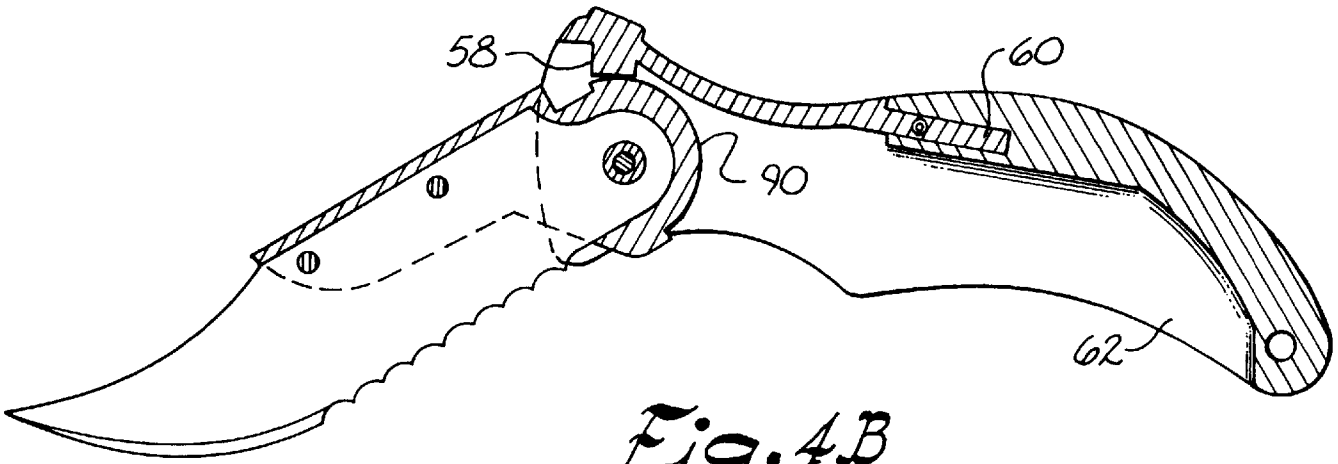
FIG. 4B is a sectional view of a knife constructed in accordance with the present invention, with the blade carrier in a position between the extended position and the closed position, and with the engagement tab being disengaged from the blade carrier notch.
Figure 4C:
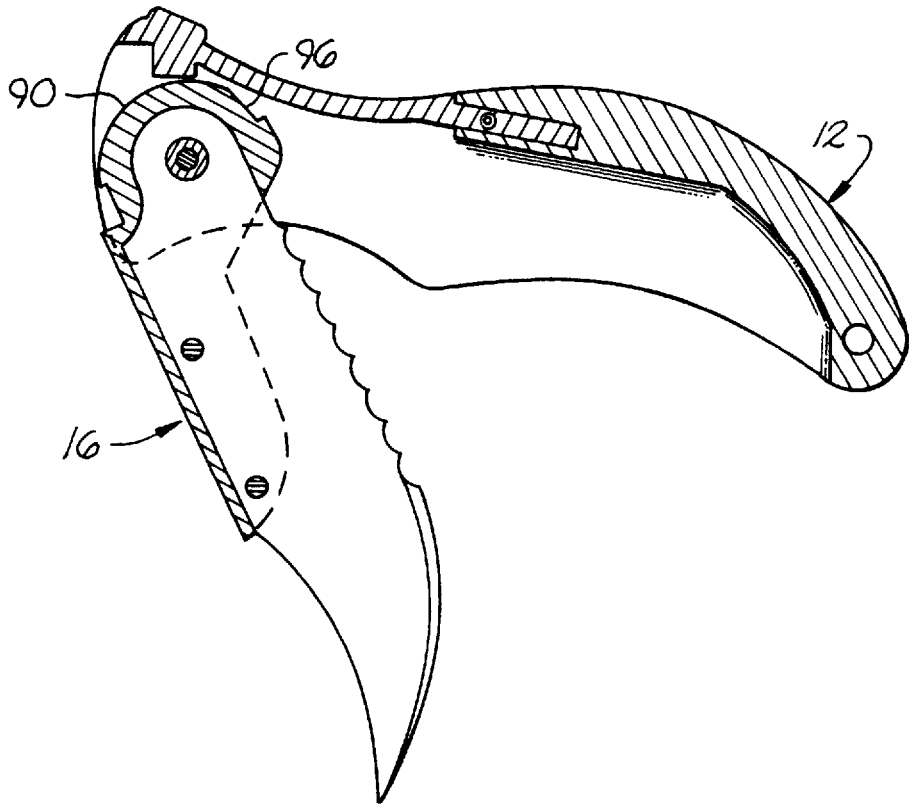
FIG. 4C is a sectional view of a knife constructed in accordance with the present invention, with the blade carrier being in an intermediate position between an extended position and a closed position.
Figure 4D:
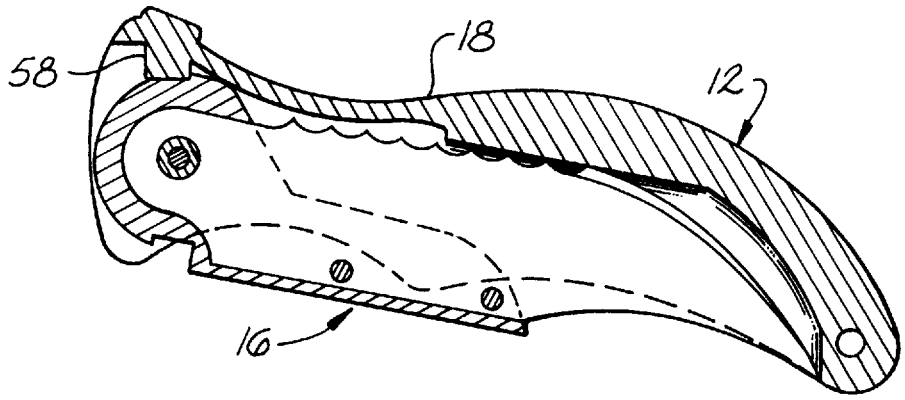
FIG. 4D is a section view of a knife constructed in accordance with the present invention, illustrating the blade carrier, and blade insert carried thereon, in a retracted position.

FIGS. 1 and 2 illustrate the knife 10 having a handle member, generally 12, a blade insert, or blade, generally 14, a blade carrier, generally 16, and a leaf spring, generally 18. Blade 14 is illustrated in FIGS. 1 and 2 in its extended position, and is illustrated in FIG. 4D in its retracted position. Blade 14 includes a cutting edge, generally 20, which includes, as illustrated in the embodiment shown in the FIGS., serrated cutting surfaces 22. It is to be understood, however, that blade 14 can have other blade cutting profiles without departing the scope of the present invention.

Figure 3B:
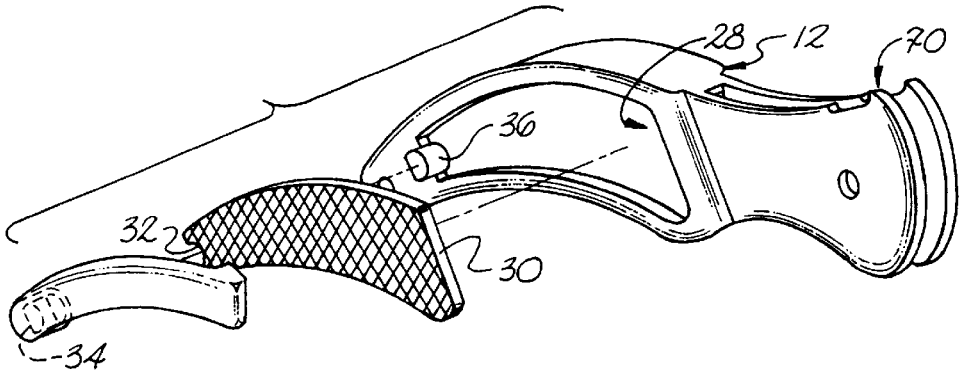
FIG. 3B is an exploded view of a portion of a knife constructed in accordance with the present invention.

Handle member 12, as illustrated in FIG. 2, is provided with an elongated flexible clip, generally 24, which can be used to clip knife 10 to the user's belt, pocket, strap, or to some other object, none of which are shown. FIG. 3B illustrates the attachment configuration of clip 24 to handle member 12. In the embodiment shown in FIG. 3B, handle members provided with a cavity 28 into which a handle insert 30 is received. Insert 30 includes a cut-out 32 into which a socket 34 of clip 24 is received when socket 34 engages with a post 36 provided in recess 28. Engagement of socket 34 to post 36 fixedly attaches clip 24 to handle member 12. Attachment of socket 34 onto post 36 could be by an interference fit, or could also be done through the use of adhesives. Likewise, handle insert 30 can be held within cavity 28 by an interference fit and/or through the use of adhesives. On the side of handle 12 opposite that of clip 24, shown in FIG. 3A, an additional cavity 40 is provided for receiving another handle insert member 42, which can likewise be held in place through an interference fit and/or through the use of adhesives.

Figure 3A:
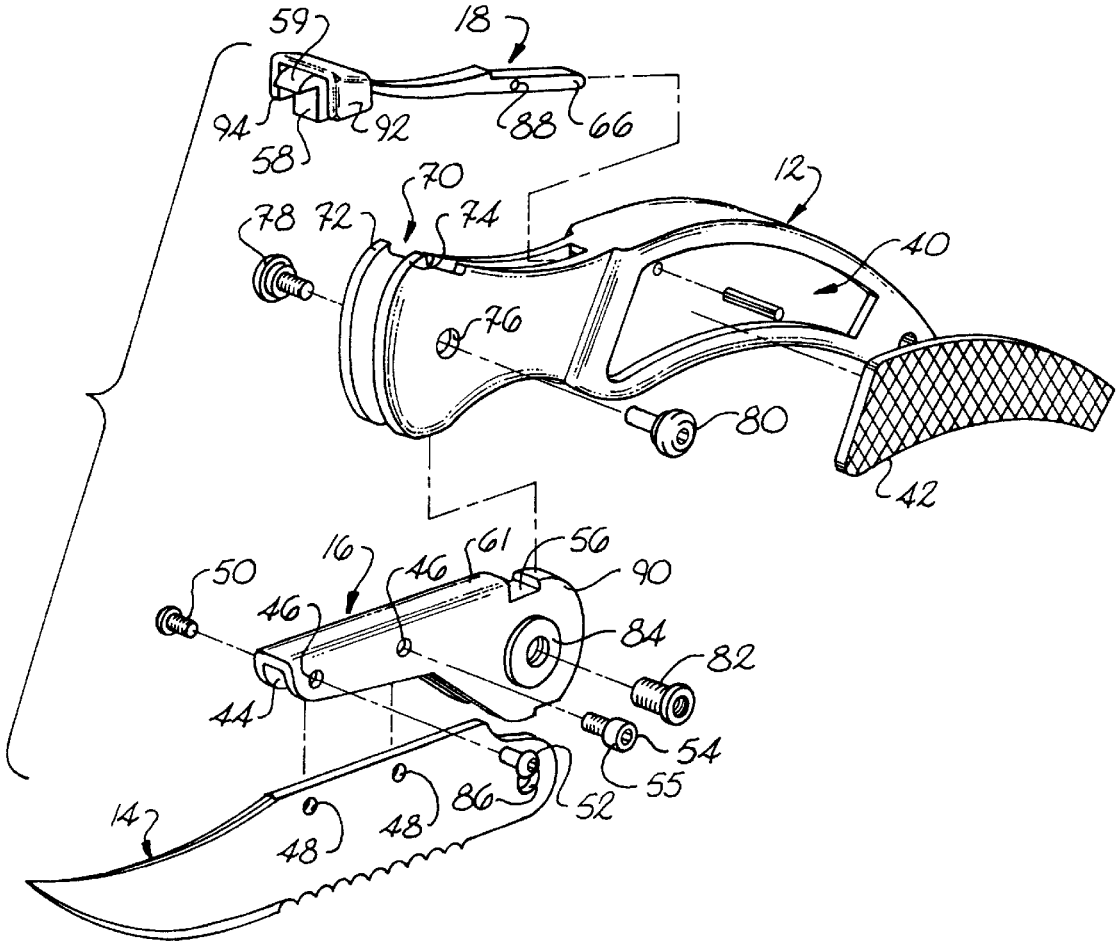
FIG. 3A is an exploded view of a knife having a blade carrier constructed in accordance with the present invention.

Blade carrier 16 is an elongated member and can be metal, wood, plastic, or some other suitable material. In the preferred embodiment, blade carrier 16 is injection molded plastic (such as glass-filled nylon) and is provided a channel portion 44 into which the upper edge of a blade 14 is received. Holes 46 are provided in blade carrier 16 for cooperating with holes 48 provided in blade insert 14, and fasteners such as a screw 50 with a threaded socket 52 can be used in those holes, or, as illustrated in FIG. 3A, one or more screws 54 having an enlarged cylindrical head 55 can be used which ultimately projects outwardly from blade carrier 16. The head 55 of such a screw 54 would be engageable by the thumb of the user to assist in opening of the blade from a closed, or retracted, position.

Provided in an upper surface of carrier 16 is a notch 56. Notch 56 is shaped for receipt of an engagement tab 58 provided on one end of leaf spring 18. Nose 59 extends outwardly from tab 58 to provide a smooth transition from spring 18 to the upper edge 61 of blade carrier 16. The other end of leaf spring 18 is elongated and is received within a slot 60 (FIGS. 4A–4B) defined in handle member 12 near blade compartment 62. Leaf spring 18 is fixed within slot 60 by use of a pin 64 such that the end 66 of spring 18 received in slot 60 is fixed against movement. Alternately, as shown in FIG. 4D, leaf spring 18 can be integrally molded with handle 12, if desired. This provides for a mounting of leaf spring 18 in cantilever fashion with respect to handle 12 and with respect to a yoke portion, generally 70, of handle member 12 formed by outwardly extending arms 72, 74.

Arms 72, 74 are provided with openings 76 through which fasteners 78, 80 are provided for retaining blade carrier 16 and blade 14 within yoke 70. Fasteners 78, 80 pass through a bushing 82 and in openings 84, 86, provided in carrier 16, and blade 14, respectively, and allow for pivoting of blade carrier, together with blade 14, with respect to yoke 70, between an extended position, as illustrated in FIGS. 1, 2, and 4A, and an retracted position, as shown in FIG. 4D.

Leaf spring 18 is provided with a hole 88 which receives pin 64, discussed above. Provided at the other end of leaf spring 18 is engagement tab 58 which rides on curved surface 90 provided on one end of blade carrier 16, as blade 14 is moved between the retracted and extended positions. Upon blade 14 being moved to the fully extended position, engagement tab 58 automatically seats itself within notch 56 of blade carrier 16. This locks blade carrier 16, and blade 14 therewith, with respect to handle member 12. To unlock carrier 16 and blade 14 so that blade 14 can be moved to the retracted position, outwardly extending ears 92, 94 provided on leaf spring 18 are grasped by the user, or at least one of them, and pulled upwardly, as shown in FIG. 4B, such that engagement tab 58 clears notch 56 of carrier 16. This allows blade 14 to be moved from the extended position to the retracted position, as shown from FIGS. 4A through 4D.

Significantly, leaf spring 18 can be integral with engagement tab 58 and ears 92, 94, and also, in a preferred embodiment, it is molded together as one unit from plastic (such as glass-filled nylon) , in an injection molding process. Likewise, handle member 12 can be injection-molded plastic as can be clip 24. Thus, most of the moving parts of knife 10 can be made from injection molded plastic (blade 14 being prefereably made of cutlery steel or the like), thereby allowing for a tough, lightweight, and relatively easy to produce knife. Further, because engagement tab 58 bears on carrier end 90 as blade 14 is moved between the retracted and extended positions, wear between tab 58 and surface 90 should be uniform, since both components can be made of the same plastic material. Also, because of the provision of carrier 16, the blade 14 of the knife can be made from a lesser amount of metal or steel, as compared to a conventional folding knife with the same blade length, thereby providing for potential weight and cost savings.

In operation, when it is desired to open knife 10, blade carrier 16 can be easily grasped by the user with one hand to open it from the retracted position, wherein blade 14 is within blade compartment 62, as shown in FIG. 4D, and pulled open to the extended state, with engagement tab 58 of leaf spring 18 continuously bearing against curve surface 90 to provide for a smooth opening of the blade 14. Frictional engagement of tab 58 on surface 90 is such that blade 14 is held against inadvertent movement, and is specifically prevented from falling or flopping out from blade compartment 62 when in a retracted state. A flattened surface 96 is provided on surface 90 which is engaged by engagement tab 58 when blade 14 is in the retracted position to further secure the blade within the handle member 12. Alternately, the user could open the blade from handle 12 by applying force to the enlarged portion of screw 54 on blade carrier 16, which provides for one-handed opening of the blade. Once the blade is open to its furthermost extended position, engagement tab 58 is urged into place within notch 56 of blade carrier 16 (through the spring biasing of leaf spring 18) to lock the blade in the extended blade. Closure of the blade requires lifting of engagement tab 58, preferably using ears 92, 94 against the force of leaf spring 18. Because of this lifting requirement in order to unlock the blade, inadvertent unlocking of the blade during use by a pressing-type force against the handle is eliminated.

From the foregoing it can be seen that knife 10 provides for a simplified folding knife having a blade locking feature with improved safety, and also the capability of accommodating different blade configurations.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A knife, comprising:

a handle member having a first end and a second end opposite said first end, said handle member defining a blade compartment;

a blade insert having a cutting edge;

a blade carrier for receiving said blade insert, said blade carrier being pivotally connected to said first end of said handle member and movable between a retracted position substantially within said blade compartment and an extended position extending outwardly from said handle member, said blade carrier defining an upper surface;

said blade carrier defining a notch in said upper surface thereof;

a leaf spring having a first end with an engagement tab and a second end fixedly connected to said handle member, said engagement tab engaging said notch in said blade carrier upon said blade carrier being moved to said extended position for automatically locking the blade carrier in said extended position;

said leaf spring having at least one ear extending outwardly beyond said handle member to allow lifting of said engagement tab from said notch of said blade carrier to unlock said blade carrier; and said blade carrier including a substantially flat portion substantially opposite said notch and defining a substantially semi-circularly curved surface extending substantially from said notch in said blade carrier to said flat portion, and wherein said engagement tab bears against said curved surface as said blade carrier moves between said retracted and extended positions.

2. A knife, comprising:

a handle member having a first end and a second end opposite said first end, said handle member defining a blade compartment;

a blade insert having a cutting edge;

a blade carrier for receiving said blade insert, said blade carrier being pivotally connected to said first end of said handle member and movable between a retracted position substantially within said blade compartment and an extended position extending outwardly from said handle member, said blade carrier defining an upper surface;

a leaf spring having a first end with an engagement member and a second end fixedly connected to said handle member, said first end of said leaf spring being a free end, such that said leaf spring is supported by said second end of said leaf spring from said handle member in a cantilevered fashion; said engagement member engaging said upper surface of said blade carrier upon said blade carrier being moved to said extended position for automatically locking the blade carrier in said extended position; said leaf spring including at least one ear extending outwardly beyond said handle member to allow lifting of said engagement member from said upper surface of said blade carrier to unlock said blade carrier;

said blade insert defining a first pivot hole and said blade carrier defining a second pivot hole; and a pivot member carried in both of said first and second pivot holes, such that said blade carrier and said blade insert both pivot about said pivot member as said blade carrier moves between said retracted and extended positions.

3. A knife, comprising:

a handle member having a first end and a second end opposite said first end, said handle member defining a blade compartment;

a blade insert having a cutting edge;

a blade carrier for receiving said blade insert, said blade carrier being pivotally connected to said first end of said handle member and movable between a retracted position substantially within said blade compartment and an extended position extending outwardly from said handle member, said blade carrier defining an upper surface; and a leaf spring having a first end with an engagement member and a second end fixedly connected to said handle member, said engagement member engaging said upper surface of said blade carrier upon said blade carrier being moved to said extended position for automatically locking the blade carrier in said extended position.

4. A knife as defined in claim 3, further comprising said blade carrier defining a notch in said upper surface for receiving said engagement member.

5. A knife as defined in claim 3, further comprising said leaf spring including at least one ear extending outwardly beyond said handle member to allow lifting of said engagement member from said upper surface of said blade carrier to unlock said blade carrier.

6. A knife as defined in claim 3, wherein said handle member, said blade carrier, and said leaf spring are molded plastic members.

7. A knife as defined in claim 3, wherein said blade carrier includes a substantially flat portion substantially opposite said upper surface of said blade carrier and defines a substantially semi-circularly curved surface extending substantially from said upper surface of said blade carrier to said flat portion, and wherein said engagement member of said leaf spring bears against said curved surface as said blade carrier moves between said retracted and extended positions.

8. A knife as defined in claim 3, further comprising an elongated clip connected to said handle member.

9. A knife as defined in claim 3, wherein said first end of said leaf spring is a free end, such that said leaf spring is supported by said second end of said leaf spring from said handle member in a cantilevered fashion.

10. A knife as defined in claim 3, wherein said leaf spring is integrally formed with said handle member.

11. A knife as defined in claim 3, wherein said blade insert defines a first pivot hole and said blade carrier defines a second pivot hole; and further comprising a pivot member carried in both of said first and second pivot holes, such that said blade carrier and said blade insert both pivot about said pivot member as said blade carrier moves between said retracted and extended positions.

* * * * *